US005121562A

United States Patent [19]

Feller

[11] Patent Number: 5,121,562

[45] Date of Patent: Jun. 16, 1992

[54] FRAMEWORK FOR MAINTAINED LEVELNESS OF A PLOW BLADE

[75] Inventor: Richard Feller, Monroe, Wis.

[73] Assignee: Monroe Truck Equipment, Inc., Monroe, Wis.

[21] Appl. No.: 681,576

[22] Filed: Apr. 5, 1991

[51] Int. Cl.[5] ..... E01H 5/04

[52] U.S. Cl. ..... 37/235; 37/232; 37/270

[58] Field of Search ..... 37/231, 234, 235, 266, 37/267, 270, 271, 232; 172/829

[56] References Cited

U.S. PATENT DOCUMENTS 2,614,344 10/1952 Rust ..... 37/231 X
2,792,650 5/1957 Kenyon ..... 37/234
3,250,026 5/1966 Jocher et al. ..... 37/232
3,285,625 11/1966 Krueger ..... 37/231 X
3,987,562 10/1976 Deen et al. ..... 37/231

*Primary Examiner*—Dennis L. Taylor
*Assistant Examiner*—Arlen L. Olsen
*Attorney, Agent, or Firm*—Kajane McManus

[57] ABSTRACT

The framework engages to a push blade of a plow assembly and extends upwardly and forwardly therefrom along a rear surface of a plow blade of the assembly, terminating at a position forward of a forward tilt pivot point for the plow blade. A chain is engaged to a center point of a horizontal cross beam of the framework which engages forward ends of a pair of upwardly and forwardly extending side beams of the framework, the framework being centered relative to the lateral extent of the plow blade.

12 Claims, 2 Drawing Sheets

FRAMEWORK FOR MAINTAINED LEVELNESS OF A PLOW BLADE

BACKGROUND OF THE INVENTION

The present invention relates to a framework which is mounted to the push frame of a plow blade and allows for level lifting and seating of the plow blade regardless of lateral angulation of the plow blade.

PRIOR ART

A difficulty in maintaining levelness of a plow blade at any degree of angulation thereof has always existed.

This difficulty arises because a plow blade is usually hung from an arm centered thereabove by two chains which radiate outwardly toward lateral ends of the plow blade from the centered point of attachment to the arm.

Upon any swivel action of the plow blade about a pivot point thereof, one chain is always stressed while the other always slackens, with the plow blade becoming unlevel with respect to a surface therebeneath.

As will be described in greater detail hereinafter, the framework of the present invention allows for dependent mounting of a plow blade from the arm thereabove by a chain which is centered relative to the lateral ends of the plow blade and which also positions the chain forward of a forward tilt pivot point for the plow blade.

BRIEF DESCRIPTION OF THE DRAWINGS

Other objects and advantages of the invention will become more apparent upon perusal of the detailed description thereof and upon inspection of the drawings in which.

SUMMARY OF THE INVENTION

According to the invention there is provided a framework which engages to a push frame of a plow assembly and extends forwardly and upwardly therefrom in a manner to be centered along the length of the blade of the plow assembly. The framework includes structure thereon which engages a centered chain for engagement to an arm above the plow blade, the framework extending forwardly to a distance which places the chain engaging structure forwardly of a forward tilt pivot point of the plow assembly as well.

DESCRIPTION OF THE PREFERRED EMBODIMENT

Figure 1:
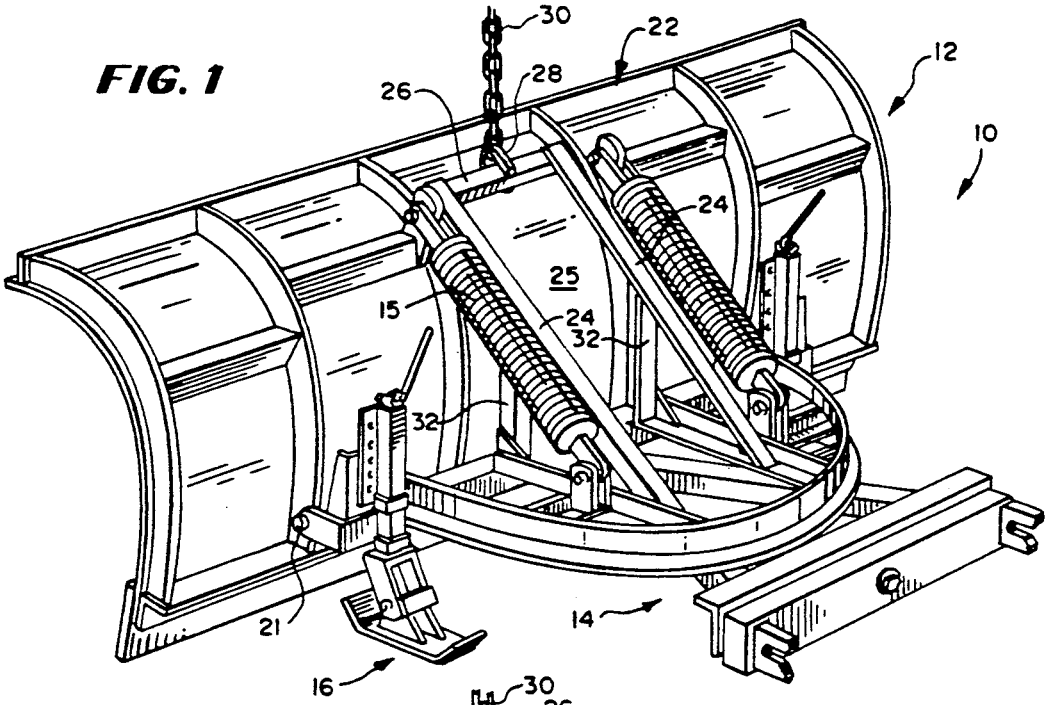
FIG. 1 is a rear perspective view of a plow assembly including the framework of the present invention.
Figure 2:
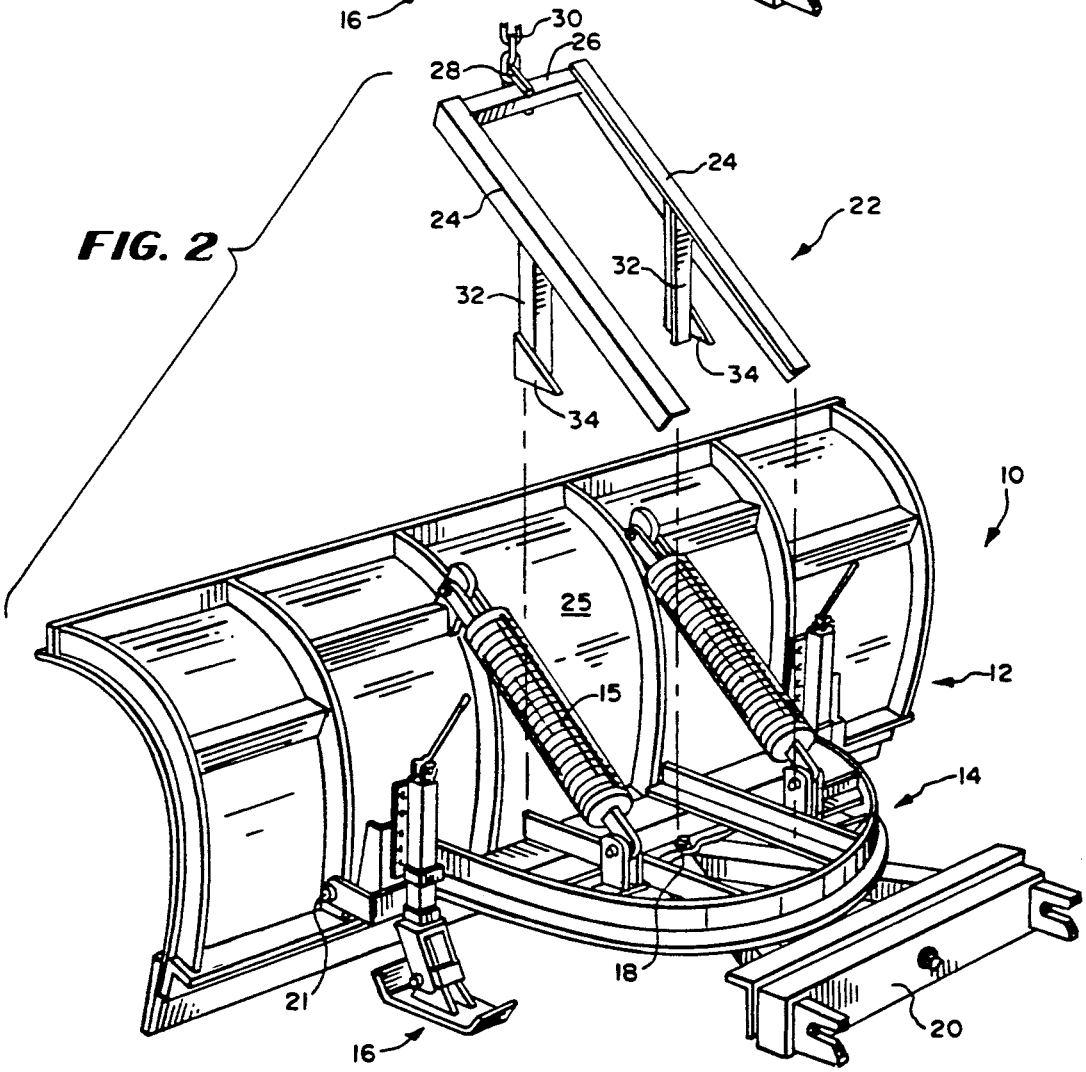
FIG. 2 is a rear perspective of the assembly of FIG. 1 and shows the framework separated therefrom.
Figure 3:
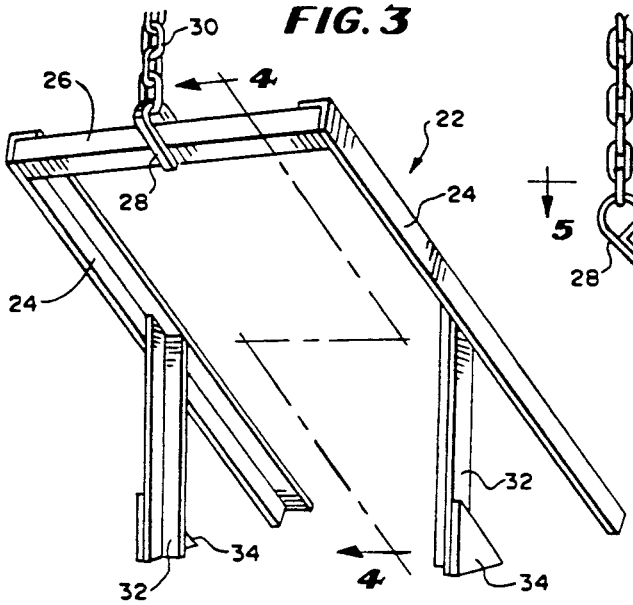
FIG. 3 is a perspective view of the framework of the present invention.
Figure 4:
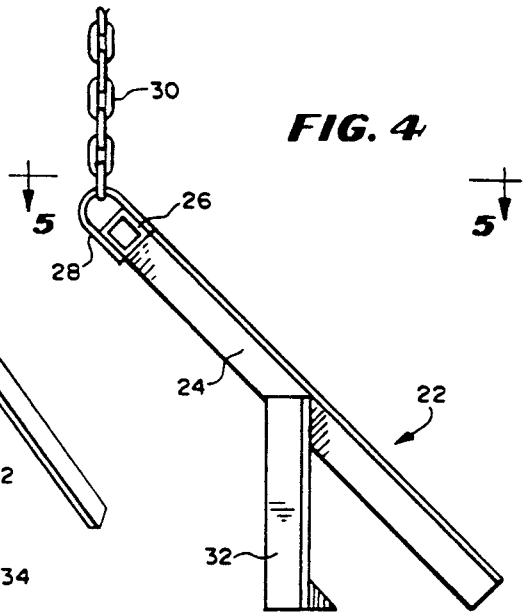
FIG. 4 is a cross sectional view of the framework taken along line 4—4 of FIG. 3.
Figure 5:
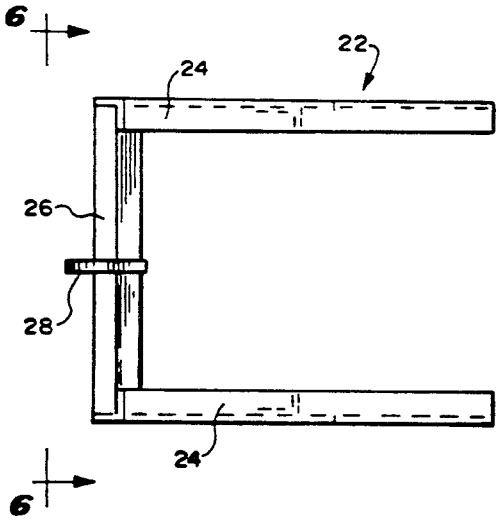
FIG. 5 is a top view of the framework.
Figure 6:
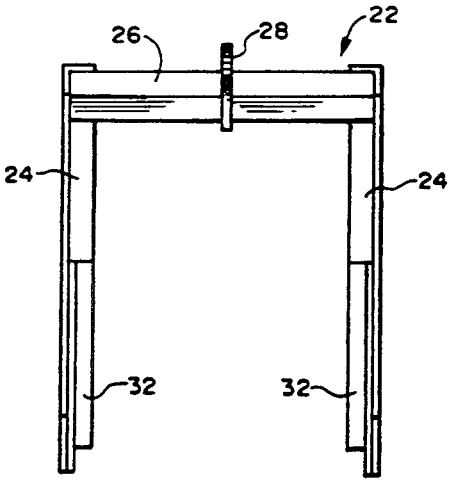
FIG. 6 is a bottom plan view of the framework taken along line 6—6 of FIG. 5.

Referring now to the drawings in greater detail, there is shown in FIGS. 1 and 2 a plow assembly 10.

The plow assembly 10 includes a plow blade 12 engaged to a push frame 14 in known manner. The frame 14 rides on skids 16 and is laterally pivotable about a point 18 where it engages a vehicle mounted swivel plate 20. Further, the plow blade 12 is capable of tilting downwardly and forwardly about a secondary pivot point 21 about which the blade 12 is engaged to the push frame 14. The push frame 14 includes a mechanical return device 15 which is engaged to the push frame 14 and the plow blade 12.

Typically such a plow assembly 10 is dependingly engaged to a centered arm (not shown) extending forwardly of the vehicle to which the assembly 10 is attached by means of two chains, each of which extend radially outwardly to engage the push frame 14 in the area where the skids 16 are engaged.

Such two chain engagement causes the plow blade 12 to become unlevel when pivoted from the position shown, with the chain closer to the swivel plate 20 becoming slack and causing a drooping of the associated end of the plow blade 12 and with the chain further from the swivel plate 20 becoming stressed and raising the associated end of the plow blade 12, causing the blade 12 to be cocked relative to the surface therebeneath.

The plow assembly 10 shown here incorporates a framework 22 made in accordance with the teachings of the present invention which virtually eliminates the cocking of the blade 12.

In this respect, the framework 22 comprises a simple structure including two side frame rails 24 which engage the push frame 14 and extend upwardly and forwardly therefrom, just behind and along a rear surface 25 of the plow blade 12 and are engaged to one another by a horizontal cross member 26 extending therebetween at a top end thereof.

The framework 22 is centered along the length of the plow blade 12 and the cross member 26 has at a centered position therealong a clamp or clip 28 from which, in the preferred embodiment, a single chain 30 extends.

The side frame rails 24 are of such length as to ensure that the clip 28 for attachment of the chain 30 to the cross member 26 is forward of the tilt pivot point 21 of the assembly 10.

In this respect, the side frame rails 24 are elongate to place the chain 30 in an appropriate position relative to the tilt pivot point 21 and, in order to ensure a secure engagement to and support of the side frame rails 24 upon the push frame 14, two vertical support rails 32 are provided which engage the push frame 14 at one end thereof and the side frame rails 24 at the other end thereof.

As shown, these vertical support rails 32 join to the side frame rails 24 at an approximately center position along the length of the side frame rails 24. Further, to provide a larger area of engagement for the vertical support rails 32, each end may be provided with a foot element 34 as shown.

The framework 22 is preferably made of angle beams and is engaged to the push frame 14 by welding. The chain clip 28 is also engaged to the framework 22 by welding after a link of the chain 30 has been trapped therein.

When the plow blade 12 is engaged in the manner shown and the chain 30 is the only point of attachment for the plow blade 12 to the arm thereabove, the blade 12 tends to remain parallel and does not cock relative to the surface therebeneath, regardless of the angulation of the plow blade 12.

It will be understood that the framework 22 can be added to any existing plow assembly 10, as well as being built in to future plow assemblies 10.

As described above, the framework 22 provides a number of advantages, some of which have been described above and others of which are inherent in the invention. Also, modifications may be proposed to the framework 22 without departing from the teachings of the present invention. For example, in the preferred embodiment disclosed, only one chain 30 is used. However, for a heavier or more cumbersome blade 12, it would be within the scope of the invention to provide two chains 30, substantially next to one another, to accommodate the blade 12. Accordingly the scope of the invention is only to be limited as necessitated by the accompanying claims.

I claim:

1. A snow plow leveling system having a chain comprising:

a push frame;

a plow blade pivotally attached to a forward portion of the push frame to form a tilt pivot point therebetween;

a mechanical return device attached to said plow blade and to said push frame;

a framework attached to the push frame and extending above said plow blade forwardly of the tilt pivot point, wherein said framework includes means, provided forward of the tilt pivot point, for engaging the chain.

2. The framework of claim 1 comprising two side beams and one end beam which engages the side beams together.

3. The framework of claim 2 further including two support beams, one engaged to each of said side beams and forming an acute angle thereto, toward a free end of each side beam.

4. The framework of claim 3 wherein each support beam includes a foot at each end thereof.

5. The framework of claim 4 wherein said beams are made of a weldable material.

6. The framework of claim 5 wherein said end beam includes a clip welded thereto at a central position therealong.

7. The framework of 6 wherein said clip is engaged to a section of chain.

8. The framework of claim 7 wherein said side beams and said support beams are angle beams.

9. The framework of claim 8 wherein said side beams are parallel to one another.

10. The framework of claim 9 wherein said end beam is perpendicular to said side beams.

11. The framework of claim wherein said clip is parallel to said side beams.

12. A snow plow leveling system having a chain comprising:

a push frame;

a plow blade pivotally attached to a forward portion of the push frame to form a tilt pivot point therebetween;

a mechanical return device attached to said plow blade and to said push frame;

a framework attached to the push frame, wherein said framework includes two side beams engaged to the push frame and extending forwardly and upwardly therefrom over a back surface of the plow blade and terminating forwardly of the forward tilt pivot point, said side beams being engaged to one another by a horizontal terminal member engaged between forward ends of the side beams, said framework being approximately centered relative to the lateral extent of the plow blade and including means, provided forward of the tilt pivot point and located centrally along the length of the horizontal terminal member of the framework, for engaging a length of chain.

* * * * *